US005955403A

United States Patent [19]

Wong

[11] Patent Number: 5,955,403

[45] **Date of Patent: *Sep. 21, 1999**

[54] SULPHUR-FREE, PAO-BASE LUBRICANTS WITH EXCELLENT ANTI-WEAR PROPERTIES AND SUPERIOR THERMAL/ OXIDATION STABILITY

[75] Inventor: Chung-Lai Wong, Sarnia, Canada

[73] Assignee: Exxon Research and Engineering Company, Florham Park, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 09/047,053

[22] Filed: Mar. 24, 1998

[51] Int. Cl.[6] ..... C10M 107/02; C10M 141/10

[52] U.S. Cl. ..... 508/282; 508/280; 508/287; 508/495; 508/433; 508/438; 508/563

[58] Field of Search ..... 508/280, 282, 508/433, 438

[56] References Cited

U.S. PATENT DOCUMENTS

| | | | |
|---|---|---|---|
| 3,697,427 | 10/1972 | Byford et al. | 252/49.9 |
| 3,790,481 | 2/1974 | Byford et al. | 252/49.9 |
| 3,923,672 | 12/1975 | Durr, Jr. et al. | 252/49.9 |
| 3,931,022 | 1/1976 | Chesluk et al. | 252/47.5 |
| 4,101,431 | 7/1978 | Kuntschik | 252/46.7 |
| 4,107,060 | 8/1978 | Schick et al. | 252/49.3 |
| 4,780,229 | 10/1988 | Mullin | 252/32.5 |
| 5,151,205 | 9/1992 | Culpon, Jr. | 252/56 R |
| 5,156,759 | 10/1992 | Culpon, Jr. | 252/56 R |
| 5,180,865 | 1/1993 | Heilman et al. | 585/10 |
| 5,382,374 | 1/1995 | Takemitsu et al. | 252/73 |
| 5,436,379 | 7/1995 | Heilman et al. | 585/10 |
| 5,681,506 | 10/1997 | Pragnell et al. | 252/405 |
| 5,681,797 | 10/1997 | Lawate | 508/280 |

FOREIGN PATENT DOCUMENTS

| | | |
|---|---|---|
| 0103884 | 3/1984 | European Pat. Off. . |
| WO 94/10270 | 5/1994 | WIPO . |

*Primary Examiner*—Ellen M. McAvoy
*Attorney, Agent, or Firm*—Joseph J. Allocca

[57] ABSTRACT

A sulfur free lubricating composition comprises a major portion of a synthetic base lubricating oil and a minor portion of a tri(alkyl phenyl) phosphate or di(alkylphenyl) phosphoric acid antiwear agent, an amine antioxidant a substituted succinamide rust inhibitor and a tolytriazole. The tri(alkylphenyl)phosphate antiwear agent is incorporated in the oil in an amount ranging between about 0.1 to 2.0 wt % and the amine antioxidant in amount ranging from about 0.1 to 5 wt %. The succinamide is present in an amount ranging from about 0.01 to 0.5 wt % and the tolytriazole, from about 0.01 to 0.5 wt %. In the foregoing, the wt % is based on the weight of oil.

8 Claims, No Drawings

SULPHUR-FREE, PAO-BASE LUBRICANTS WITH EXCELLENT ANTI-WEAR PROPERTIES AND SUPERIOR THERMAL/ OXIDATION STABILITY

FIELD OF THE INVENTION

This invention relates to synthetic lubricating oil compositions. The invention particularly relates to synthetic lubricating oils which are free of sulfur, have excellent anti-wear properties and have thermal and oxidation stability.

BACKGROUND OF THE INVENTION

Synthetic lubricants find increasing utility because of their uniformity and because they are free of undesirable sulfur constituents. In order to meet users increasingly stringent criteria, these synthetic lubricating oils are typically modified by the addition of additives such as ashless antiwear agents, corrosion inhibitors, antioxidants and the like.

Although phosphorous-containing, anti-wear additives have been proposed for use in synthetic lubricating oils, their use is associated with certain drawbacks. In general phosphorous-containing, anti-wear additives are poor extreme pressure agents. Moreover, their thermal and oxidation stability are poor, giving rise to metal corrosive species and sludge. Similarly sulfur and phosphorous containing antiwear additives have been proposed for use in synthetic lubricating oils and while these additions tend to have good extreme pressure properties, they too are not very thermally stable and give rise to corrosive decomposition products.

Polyol esters have been used in synthetic lubricants as an additive and sludge solubilizing medium; however, it appears that increased amounts of polyol esters also decompose to form corrosive species.

Thus, there remains a need for synthetic lubricant compositions with good antiwear and extreme pressure properties and enhanced thermal/oxidation stability.

SUMMARY OF THE INVENTION

According to the invention, there is provided a sulfur free lubricating composition comprising a major portion of a synthetic base lubricating oil and a minor portion of a tri(alkyl phenyl)phosphate or di(alkylphenyl)phosphoric acid antiwear agent, an amine antioxidant a substituted succinamide rust inhibitor and a tolytriazole.

The tri(alkylphenyl)phosphate or di(alkylphenyl) phosphoric acid antiwear agent is incorporated in the oil in an amount ranging between about 0.1 to 2.0 wt % and the amine antioxidant in amount ranging from about 0.1 to 5 wt %. The succinamide is present in an amount ranging from about 0.01 to 0.5 wt % and the tolytriazole, from about 0.01 to 0.5 wt %. In the foregoing, the wt % is based on the weight of oil.

This and other embodiments will be described in detail hereinafter.

DETAILED DESCRIPTION OF THE INVENTION

The synthetic base lubricating oil useful in the present invention is any polyalphaolefin (PAO) or mixtures thereof having a kinematic viscosity of about 1.8 to about 300 cSt at 100° C. These oils are inherently free of sulfur, phosphorous and metals.

Polyalphaolefins are prepared by the oligomerization of 1-decene or other olefins to produce lubricant range hydrocarbons.

The synthetic base oil, of course, comprises the major portion of the lubricating composition of the invention. Typically, the base oil will comprise from about 50 to about 95 wt % of the total composition.

Incorporated in the composition is a minor portion of a tri(alkylphenyl)phosphate antiwear (AW) agent, an amine antioxidant (AO), a succinamide rust inhibitor (RI) and a tolytriazole.

The tri(alkylphenyl)phosphate or di(alkylphenyl) phosphoric acid useful in the composition of this can be represented by the formula:

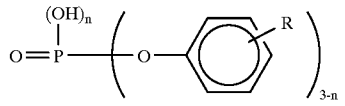

where n is 0 or 1 and wherein R is an alkyl group of from about 2 to about 6 carbon atoms, and preferably 3 to 4 carbon atoms. In general, the tri(alkylphenyl)phosphate or di(alkylphenyl)phosphoric acid is present in an amount ranging between about 0.1 to about 2.0 wt % based on the weight of the oil and preferably from about 0.7 to about 1.0 wt %.

Although any amine antioxidant used in lubricant compositions may be employed, it is particularly preferred to use phenyl amines, phenyl naphthylamines and their alkylated derives which can be represented by the formula:

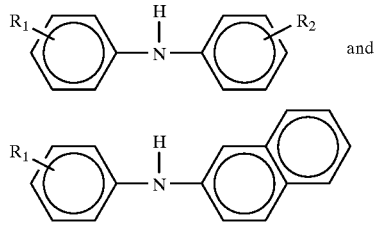

wherein $R_1$ and $R_2$ are independently H and alkyl groups having from about 3 to about 14 carbon atoms and preferably 4 to 9 carbon atoms. In general, the amine antioxidant will be present in an amount ranging from about 0.1 to 5 wt % based on the weight of oil and preferably, about 0.5 to 1.5 wt %.

Included in the composition of the present invention is a substituted succinamide rust inhibitor. Such succinamide compounds are well-known in the art. In the present invention preferred succinamide compounds are those formed by reacting an amino acid amide with an alkenyl succinic acid or succinic anhydride. Illustrative of amino acid amides are those compounds formed by reacting a polyamine such as triethylene tetramine with a monocarboxylic acid such as oleic acid. Illustrative alkenyl succinic acids are decenyl, dodecenyl, tetradecenyl succinic acid. Typically, the substituted succinamide will be present in an amount ranging from about 0.02 to about 0.3 wt % based on the weight of the oil, and preferably about 0.04 to 0.15 wt %.

The tolyltriazoles suitable as a minor portion of the compositions of the invention are hydrocarbon substituted tolyl 1,2,3 triazoles, amino alkyl substituted 1,2,3 tolyl triazoles and alkyl amino alkyl 1,2,3 tolyl triazoles. A particularly preferred tolyl triazole is represented by the formula:

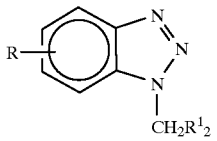

wherein R and $R^1$ are independently hydrogen or a $C_1$ to $C_{20}$ hydrocarbyl radical.

Typically, the tolyltriazole will be present in an amount ranging from about 0.01 to about 0.5 wt % based on the weight of oil and preferably 0.03 to 0.2 wt %.

The compositions of the invention may also include an polyol ester solubilizer. Suitable esters may comprise diesters of aliphatic $C_6$ to $C_{12}$ dicarboxylic acids, and those made from $C_5$ to $C_{12}$ monocarboxylic acids and polyols. Diesters, triesters, tetra-esters and mixtures there useful in the present invention typically have molecular weight ranging from about 350 to about 1000. Particularly preferred is a neopenty polyol ester represented by the formula $$C(CH_2OCOR^1)_2(CH_2OCOR^2)_2$$

wherein $R^1$ is a linear of 7 to 9 carbon alkyl group and $R^2$ is a branched alkyl group of from 5 to 10 carbon atoms, and preferably 7 carbon atoms.

In general, the ester solubilizer will not exceed more than about 30 wt % of the total weight of the composition. Indeed, it is preferred that a polyol ester be incorporated in the composition only when the viscosity of the synthetic base oil is such that a solubilizer is required for the additives. Typically, when the viscosity of the oil is above about 12 cSt at 100° C. an ester solubilizer will be used.

The compositions of the invention may also include a thickener to increase the viscosity of the composition. Suitable thickness includes high viscosity PAO's, polyisobutylene, ethylene propylene copolymers and similar thickeners. In general, these thickeners will not exceed 30 wt % based on the weight of oil.

The following examples will serve to further illustrate the invention.

EXAMPLES

The following nineteen lubricating oil compositions demonstrate formulations of the present invention. The composition of each formulation is given in the Table of Formulations. Identification of the components used in the formulation is given in the Table of Components. These lubricating oil compositions were subjected to various tests which along with the test results are listed in the Table of Tests and Results.

TABLE OF FORMULATIONS

| | FORMULATIONS | | | | | | | | | |
|---|---|---|---|---|---|---|---|---|---|---|
| COMPONENTS | 1 | 2 | 3 | 4 | 5 | 6 | 7 | 8 | 9 | 10 |
| Base Oil, wt % | | | | | | | | | | |
| A | 39.1 | | | | | | | | | |
| B | 43.93 | 76.1 | | | | | | | | |
| C | | 16.93 | 91.3 | 74.4 | 64.32 | 45.4 | 28.4 | 11.03 | | |
| D | | | 1.73 | 18.63 | 23.71 | 42.63 | 59.63 | 77 | 76.8 | 45.2 |
| E | 10 | | | | | | | | 11.2 | 42.8 |
| AW Additive, wt % | 0.8 | 0.8 | 0.8 | 0.8 | 0.8 | 0.8 | 0.8 | 0.8 | 0.8 | 0.8 |
| F | | | | | | | | | | |
| Amines, wt % | | | | | | | | | | |
| G | 1 | 1 | 1 | 1 | 1 | 1 | 1 | 1 | 1 | 1 |
| H | | | | | | | | | | |
| Rust Inhibitor, wt % | 0.07 | 0.07 | 0.07 | 0.07 | 0.07 | 0.07 | 0.07 | 0.07 | 0.07 | 0.07 |
| I | | | | | | | | | | |
| Tolyltriazole, wt % | 0.1 | 0.1 | 0.1 | 0.1 | 0.1 | 0.1 | 0.1 | 0.1 | 0.1 | 0.1 |
| J | | | | | | | | | | |
| Ester, wt % | | | | | | | | | | |
| K | 5 | 5 | 5 | 5 | 5 | 5 | 5 | 5 | 5 | 5 |
| L | | | | | | | | | | |
| M | | | | | | | | | | |
| N | | | | | | | | | | |

TABLE OF FORMULATIONS-continued

| | | | | | | | | | |
|---|---|---|---|---|---|---|---|---|---|
| Thickener, wt % O | | | | | 5 | 5 | 5 | 5 | 5 | 5 |

| | FORMULATIONS | | | | | | | | |
|---|---|---|---|---|---|---|---|---|---|
| COMPONENTS | 11 | 12 | 13 | 14 | 15 | 16 | 17 | 18 | 19 |
| Base Oil, wt % | | | | | | | | | |
| A | | | | | | | | | |
| B | | | | | | | | | |
| C | | | 77.03 | 77.03 | 77.03 | 77.03 | 77.03 | 77.03 | |
| D | 14 | | 16 | 16 | 16 | 16 | 16 | 16 | 59.03 |
| E | 74 | 77 | | | | | | | 24 |
| AW Additive, wt % F | 0.8 | 0.8 | 0.8 | 0.8 | 0.8 | 0.8 | 0.8 | 0.8 | 0.8 |
| Amines, wt % | | | | | | | | | |
| G | 1 | 1 | 1 | 1 | 1 | 1 | | | 1 |
| H | | | | | | | 1 | 1 | |
| Rust Inhibitor, wt % I | 0.1 | 0.1 | 0.07 | 0.07 | 0.07 | 0.07 | 0.07 | 0.07 | 0.07 |
| Tolyltriazole, wt % J | 0.1 | 0.1 | 0.1 | 0.1 | 0.1 | 0.1 | 0.1 | 0.1 | 0.1 |
| Ester, wt % | | | | | | | | | |
| K | 5 | 5 | 5 | | | | | 5 | 5 |
| L | | | | 5 | | | 5 | | |
| M | | | | | 5 | | | | |
| N | | | | | | 5 | | | |
| Thickener, wt % O | 5 | 16 | | | | | | | 10 |

TABLE OF COMPONENTS

| | | | |
|---|---|---|---|
| BASE OILS | A | PAO-2 | Polyalphaolefins; 2 cSt @ 100° C.; Oronite |
| | B | PAO-6 | Polyalphaolefins; 6 cSt @ 100° C.; Ethyl or Mobil |
| | C | PAO-8 | Polyalphaolefins; 8 cSt @ 100° C.; Ethyl or Mobil |
| | D | PAO-40 | Polyalphaolefins; 40 cSt @ 100° C.; Mobil |
| | E | PAO-100 | Polyalphaolefins; 100 cSt @ 100° C.; Mobil |
| AW AGENT | F | Durad 310M | Tri-(isopropylphenyl)phosphate; FMC |
| AMINE | G | Naugalube 438L | Di-nonyl-diphenylamine; Uniroyal |
| RUST INHIBITOR | I | Hitec 536 | Alkenyl succinamide derivative; Ethyl Corp; |
| TOYLTRIAZOL | J | Irgamet 39 | 1,2,3 tolyltriazole derivative |
| ESTERS | K | NP-439 | Reaction product of Pentaerythritol and aliphatic and branched carboxylic acids; Exxon Chemical Co. |
| | L | NP-353 | Reaction product of Trimethylol propane and aliphatic and branched carboxylic acids; Exxon Chemical Co. |
| | M | DOS | Di-octylsebacate |
| | N | NP-317 | Reaction product of Trimethylol propane and aliphatic and branched carboxylic acids |
| THICKENER | O | Parapoid 11279 | Polyisobutylene with averaged MW of about 2500; Exxon Chemical Co. |

TABLE OF TEST AND RESULTS

| Test | Test Method | FORMULATIONS 1 | 2 | 3 | 4 | 5 | 6 | 7 | 8 | 9 | 10 |
|---|---|---|---|---|---|---|---|---|---|---|---|
| Viscosity at 40° C. | D445 | 19.81 | 32.6 | 47 | 66.9 | 98 | 147 | 214.1 | 317.5 | 467.1 | 678.3 |
| Viscosity at 100° C. | D445 | 4.58 | 6.08 | 7.82 | 10.24 | 13.66 | 18.5 | 24.41 | 32.61 | 43.81 | 60.1 |
| Rust Test | D665B | P | P | | | | | | | | P |
| Rust Test | D665B | P | P | | | | | P | | | P |
| Cu Corrosion at 121° C. | D130 | | 1A | | | | | 1B | | | 1B |
| 4 Ball Wear (mm WSD) | D2266 | | 0.36 | | | | | | | | |
| Demulsibility | D1401 | | 41-39-0 | | | | | 41-39-0 | | | 43-37-0 |
| Demulsibility; % water in oil | D2711 | | 0.1 | | | | | 0.8 | | | 1.4 |
| Demulsibility; Emulsion | D2711 | | 0 | | | | | 0 | | | 0 |
| Demulsibility; free water (ml) | D2711 | | 86 | | | | | 84.9 | | | 80.1 |
| Foaming: Seq I | D892 | | 0/0 | | | | 0/0 | | | | 0/0 |
| Foaming: Seq II | D892 | | 0/0 | | | | 0/0 | | | | 30/0 |
| Foaming: Seq III | D892 | | 0/0 | | | | | 0/0 | | | 0/0 |
| Rotary Bomb Oxidation (min) | D2272 | | 11051155; 1400 | | | | | | | 1300 | |
| Oxidation test (% Vis Increase) | | 0.1 | 0.1 | 0.1 | 0.1 | 0.1 | 0.1 | 0.1 | 0.1 | 0.1 | 0.1 |
| Sludge Test (mg/100 ml) | D4310 | | 25 | | | | | | | | |
| Cincinnati-Milacron Thermal Test; Sludge (mg/100 ml) | A | | 3.8 | | | | | | | | |
| Wear test (FLS) | FZG | | >12 | | >13 | | | >12 | | | >13 |

| Test | Test Method | FORMULATIONS 11 | 12 | 13 | 14 | 15 | 16 | 17 | 18 | 19 |
|---|---|---|---|---|---|---|---|---|---|---|
| Viscosity at 40° C. | D445 | 969.8 | 1455.5 | | | | | | | |
| Viscosity at 100° C. | D445 | 80.3 | 107.8 | | | | | | | |
| Rust Test | D665B | P | P | | | | | | | |
| Rust Test | D665B | | | P | | | | | | P |
| Cu Corrosion at 121° C. | D130 | | 1B | 1B | | | | | | 1B |
| 4 Ball Wear (mm WSD) | D2266 | | | 0.325 | | | | | | |
| Demulsibility | D1401 | | 43-37-0 | 42-38-0 | | | | | | 42-38-0 |
| Demulsibility; % water in oil | D2711 | | | | | | | | | |
| Demulsibility; Emulsion | D2711 | | | | | | | | | |
| Demulsibility; free water (ml) | D2711 | | 86 | | | | | 84.9 | | |
| Foaming: Seq I | D892 | | 0/0 | 0/0 | | | | | | |
| Foaming: Seq II | D892 | | 0/0 | 20/0 | | | | | | |
| Foaming: Seq III | D892 | | 0/0 | 0/0 | | | | | | |
| Rotary Bomb Oxidation (min) | D2272 | | | 1605 | 1800 | 1993 | 1635 | 1905 | 1530 | 1600 |
| Oxidation test (% Vis Increase) | D2893 | | | | | | | | | |
| Sludge Test (mg/100 ml) | D4310 | | | 25.5 | 72 | 20.7 | 30.5 | 10.2 | | 6.3 |
| Cincinnati-Milacron Thermal Test; Sludge (mg/100 ml) | A | | | 4 | 4.4 | | 3.6 | 13.55 | 6.4 | 11.1 |
| Wear test (FLS) | FZG | | | | | | | | | >13 |

What is claimed is:

1. A lubricating composition comprising:

a major portion of at least one polyalphaolefin base lubricating oil; and, based on the weight of oil (i) from 0.1 to 2 wt % of a tri-(alkylphenyl)phosphate or di(alkylphenyl)phosphoric acid;

(ii) from 0.1 to 5 wt % of an amine antioxidant;

(iii) from 0.01 to 0.5 wt % of a substituted succinamide; and (iv) from 0.01 to 0.5 wt % of a tolyltriazole.

2. The composition of claim 1 wherein the tri (alkylphenyl)phosphate or di(alkylphenyl)phosphoric acid is represented by the formula:

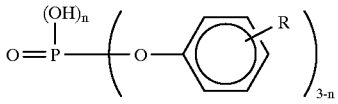

where n is 0 or 1, and R is an alkyl group of from about 2 to about 6 carbon atoms.

3. The composition of claim 1 wherein the amine antioxidant is selected from the group consisting of diphenyl amines, phenyl naphthylamines, and alkyl derivatives having from about 4 to 14 carbon atoms in the alkyl group.

4. The composition of claim 1 wherein the tolyltriazole has the formula:

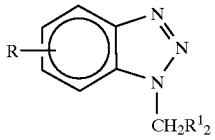

wherein R and $R^1$ are independently hydrogen or a $C_1$ to $C_{20}$ hydrocarbyl radical.

5. The composition of claim 1 including a thickener.

6. The composition of claim 5 including an ester solubilizer in an amount not greater than 30 wt %.

7. The composition of claim 6 wherein the polyol ester is represented by the formula:

$$C(CH_2OCOR^1)_2(CH_2OCOR^2)_2$$

where $R^1$is a linear alkyl group of from 7 to 9 carbon atoms and $R^2$ is a branched alkyl group of from 5 to 10 carbon atoms.

8. A lubricating composition comprising:

a major portion of at least one polyalphaolefin base lubricating oil; and based on the weight of oil, (i) from 0.1 to 2 wt % of an (alkyl phenyl) phosphate having the formula:

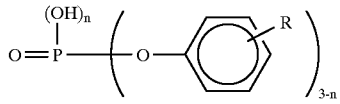

where n is 0 or 1, and R is an alkyl group from about 2 to about 6 carbon atoms (ii) from 0.1 to 5 wt % of an amine antioxidant selected from the group consisting of diphenyl amine, phenyl naphthylamines, and alkyl derivatives thereof having from about 4 to 14 carbon atoms in the alkyl group; and (iii) from 0.01 to 0.5 wt % of the tolyltriazole having the formula:

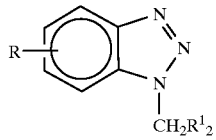

wherein R and $R^1$ are independently hydrogen or a $C_1$ to $C_{20}$ hydrocarbyl radical, and when the base oil has a viscosity greater than about 12 cSt at 100° C., an ester solubilizer in an amount not greater than 30 wt % and having the formula:

$$C(CH_2OCOR^1)_2(CH_2OCOR^2)_2$$

where $R^1$ is a linear alkyl group of from 7 to 9 carbon atoms and $R^2$ is a branched alkyl group of from 5 to 10 carbon atoms.

* * * * *